US007850241B1

(12) United States Patent
Lucci et al.

(10) Patent No.: US 7,850,241 B1
(45) Date of Patent: Dec. 14, 2010

(54) NESTABLE AND STACKABLE CHAIR

(75) Inventors: Roberto Lucci, Como (IT); Paolo Orlandini, Milan (IT)

(73) Assignee: Ditto Sales, Inc., Jasper, IN (US)

( * ) Notice: Subject to any disclaimer, the term of this patent is extended or adjusted under 35 U.S.C. 154(b) by 0 days.

(21) Appl. No.: 12/876,828

(22) Filed: Sep. 7, 2010

Related U.S. Application Data

(63) Continuation of application No. 11/385,207, filed on Mar. 21, 2006, now abandoned.

(51) Int. Cl.
*A47C 1/121* (2006.01)

(52) U.S. Cl. ..... 297/331; 297/341; 297/239

(58) Field of Classification Search ..... 297/320, 297/342, 239, 14, 331, 313, 336, 448.1, 450.1, 297/341
See application file for complete search history.

(56) References Cited

U.S. PATENT DOCUMENTS 145,229 A * 12/1873 Nolan ..... 297/324
155,452 A * 9/1874 Koechling ..... 297/317
562,606 A * 6/1896 Henry ..... 297/324
1,213,920 A * 1/1917 Szymkowiak ..... 297/332
6,742,839 B2 * 6/2004 Piretti ..... 297/239
7,147,286 B2 * 12/2006 Cesaroni et al. ..... 297/301.1
2005/0264060 A1 * 12/2005 Cesaroni et al. ..... 297/239

FOREIGN PATENT DOCUMENTS

GB 2068216 A * 8/1981

* cited by examiner

*Primary Examiner*—Joseph Edell
(74) *Attorney, Agent, or Firm*—Maginot, Moore & Beck LLP

(57) ABSTRACT

A chair is provided comprising a seat assembly including a seat back and a seat bottom and a support frame including a left leg assembly and right leg assembly connected by a transverse support member. The seat back is pivotably connected to each of the leg assemblies such that an upper portion of the seat back pivots in relation to the leg assemblies between a first seat back position and a second seat back position. The seat bottom is rotatable in relation to the seat back between an upright position and a horizontal position. The seat bottom is slidingly engaged with the leg assemblies such that pivoting of the seat backward from the first seat back position to the second seat back position causes the seat bottom to slide forward from a first seat bottom position to a second seat bottom position.

20 Claims, 13 Drawing Sheets

NESTABLE AND STACKABLE CHAIR

REFERENCE TO RELATED APPLICATION

This application is a continuation application of and claims priority to co-pending U.S. patent application Ser. No. 11/385,207, filed on Mar. 21, 2006.

BACKGROUND OF THE INVENTION

The present invention relates generally to the field of seating and in particular to a reclining chair that is stackable and nestable.

Chairs for extended seating applications, such as banquet halls and conference rooms, should preferably be comfortable, durable, and either stackable or nestable for storage purposes. Traditional stackable banquet chairs include a pair of inverted-U-shaped leg members attached to opposite sides of a generally horizontal seat. A generally L-shaped back support frame interconnects with the leg members and extends upwardly from the rear of the seat to support a back cushion. This type of chair may be stacked by placing the inverted-U-shaped leg members of one chair over the top of the leg members of another chair, such that the seat of the upper chair is supported just above the seat of the lower chair. Examples of traditional stackable banquet chairs are shown in U.S. Pat. No. 3,102,733 to Burnett and U.S. Design Pat. No. 180,996 to Cramer. While this type of chair has wide applicability, many people prefer chairs that do not look like a traditional stacking chair. These traditional stacking chairs have the leg members completely exposed at the sides of the chairs. Some users prefer legs or leg members that are less visible.

The above-described chair is generally referred to as a stacking chair, because the leg members of one chair rest directly on the leg members of a lower chair creating a secure leg-on-leg stack. Multiple chairs may be securely stacked on top one another with this design.

An alternative to stacking chairs are so-called nesting chairs. Nesting chairs come in a variety of styles and are distinguished from stacking chairs in that the underside of a seat frame of one chair rests atop the seat cushion of a lower chair when the chairs are nested. An example of such a nesting chair is illustrated in U.S. Pat. No. 5,524,963 to Barile. An advantage with nesting chair designs is that the chair designer may configure the chair legs to be less exposed than with traditional stacking chairs.

Modem consumers require comfort and style in their chairs, but also demand cost-effective solutions given the highly competitive furniture industry. Further, the chairs must be durable and rugged, yet preferably mechanically simple, easily assembled, lightweight, and low-cost. Still further, many consumers want a modern appearance and a chair design that takes advantage of modern materials, part-forming processes, and assembly techniques. Often consumers need chairs that are mobile and that can be stored in dense arrangements that minimize the storage space required.

A problem is that these requirements create conflicting design criteria. For example, low-cost chairs tend to be less comfortable and less stylized. Chairs that are more comfortable, such as so-called "synchrotilt" chairs, have more expensive components and greater assembly costs, are neither stackable nor nestable for dense storage, and are usually too heavy to be lifted and/or stacked for storage.

A need has remained for a chair combining the benefits of an ergonomic design in a stackable and/or nestable chair.

SUMMARY OF THE INVENTION

In order to address these needs, the present invention contemplates a chair comprising a seat assembly including a seat back and a seat bottom and a support frame including a left leg assembly and right leg assembly connected by a transverse support member, each of the leg assemblies including a seat back support member. The seat back is pivotably connected to each of the seat back support members such that an upper portion of the seat back pivots in relation to the seat back support members between a first seat back position and a second seat back position. The seat bottom is rotatably connected to a lower portion of the seat back such that the seat bottom is rotatable in relation to the seat back between an upright position and a horizontal position. The seat bottom is slidingly engaged with the seat back support members such that pivoting of the upper portion of the seat backward from the first seat back position to the second seat back position causes the lower portion of the seat back to pivot forward thereby causing the seat bottom to slide forward in relation to the seat back support members from a first seat bottom position to a second seat bottom position.

The configuration of the support frame and seat assembly allows the chair to be stacked with other chairs having a similar configuration when the seat bottom is in the horizontal position. Moreover, the same configuration allows the chair to be nested with other chairs having a similar configuration when the seat bottom is in the upright position.

The left and right leg assemblies may be comprised of a front leg member and a rear leg member connected in a criss-cross configuration. Lower portions of the front leg members and the rear/leg members may be continuously downwardly curved from the crossing point of the front leg member and the rear leg member such that the front leg member and the rear leg member exhibit an arched configuration in profile that provides a sturdy base for supporting and distributing the weight of a person sitting in the chair.

In a preferred embodiment, the seat back includes a back panel and a left and right upright support member. An upper portion of each upright support member is attached to lateral ends of said back panel. A central portion of the left and right upright support members is pivotably connected to the respective seat back support members.

The seat bottom preferably includes left and right laterally extending attachment members for rotatably connecting to a lower portion of said left and right upright support members. The lower portions of the upright support members are preferably located in a pivot guide channel inside the respective seat back support members when the upright support members are pivotably attached to the seat back support members. The seat back support members may each have an opening to the pivot guide channel on an inboard side of each of the respective seat back support members. The lower portions of the upright support members and the left and right attachment members of the seat bottom may be rotatably connected through the respective openings. The opening may act as a slide guide to guide the sliding of the seat bottom between the first seat bottom position and the second seat bottom position.

In some embodiments, the seat back support members include a biasing element for biasing the lower portions of the upright support members backward thereby pivoting the upper portions of the upright support members back into the first seat back position.

Accordingly, it is one object of the invention to provide an ergonomic chair that includes features that allow a user to easily recline the chair while the seat back maintains support for the user's back. Another object is achieved by features of the invention that allow the chair to not only recline, but also be easily stacked or nested when not in use.

These and other objects and benefits of the invention will be readily discerned from the following written description, taken together with the accompanying figures.

DESCRIPTION OF THE PREFERRED EMBODIMENTS

Figure 1:
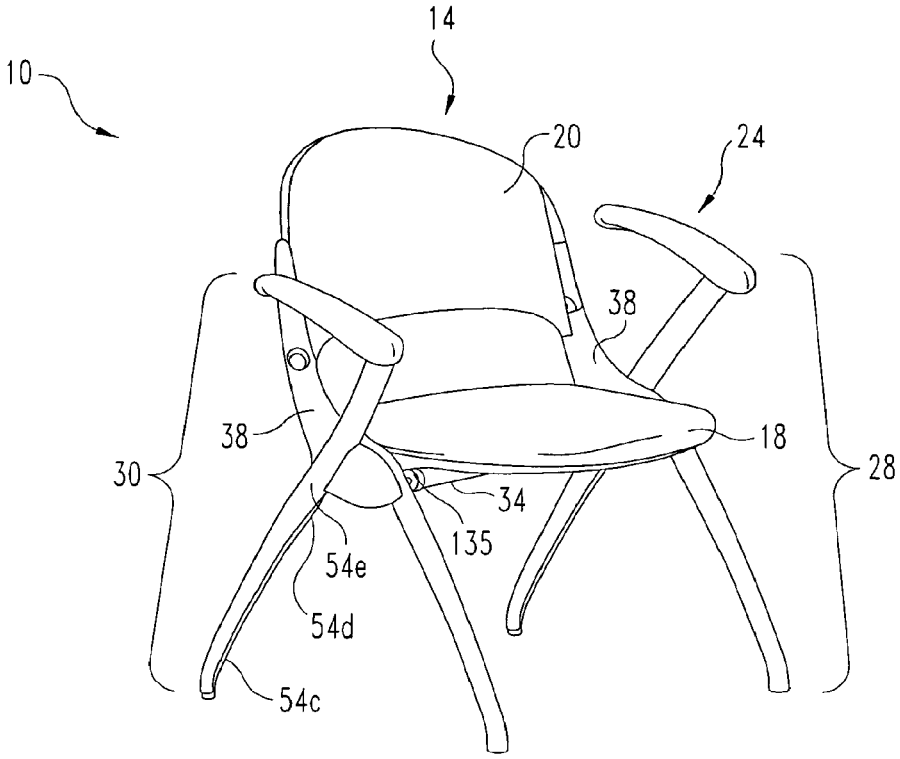
FIG. 1 is a front perspective view of a chair according to one embodiment of the present invention.
Figure 2:
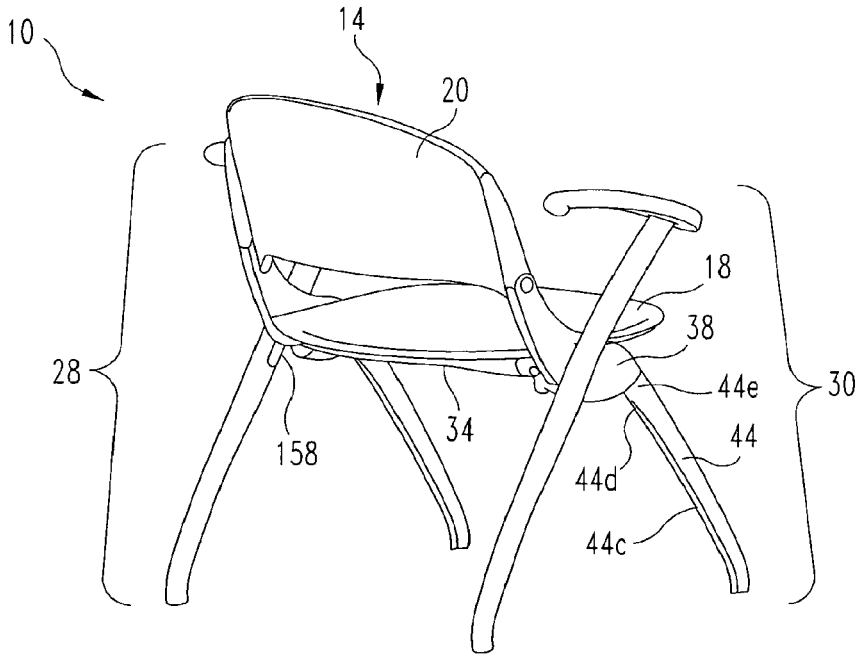
FIG. 2 is a rear perspective view of the chair of FIG. 1.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The present invention provides a chair with a synchronously moving seat and seat back. The seat slides forward as the seat back tilts rearward to provide a reclined seating position in response to the natural forward movement of the seated user's pelvis along with the user leaning against the seat back. The biasing spring of the seat allows it to return to an upright seating position when the pressure on the seat back is removed. The chair includes a fold-up seat that allows the chair to be stacked vertically or nested horizontally to suit a wide variety of storage needs.

Figure 3:
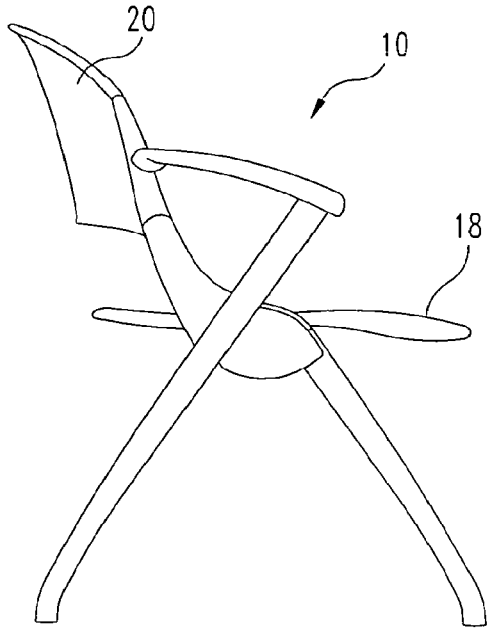
FIG. 3 is a side elevational view of the chair shown in FIG. 1 in the upright position.
Figure 4:
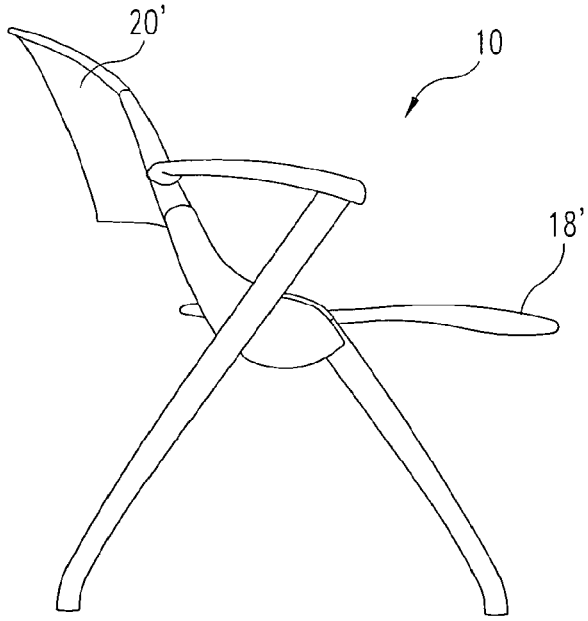
FIG. 4 is a side elevational view of the chair shown in FIG. 1 in the reclined position.

Referring to the drawings, a chair 10 in accordance with one embodiment of the invention is illustrated in FIGS. 1-4. The chair 10 includes a seat assembly 14 having a seat bottom portion 18 and a seat back portion 20. The seat bottom 18 and seat back 20 of the seat assembly are supported by a support frame 24 which includes a left leg assembly 28 and right leg assembly 30 connected by a transverse support member 34. Each of the leg assemblies 28, 30 includes a seat back support member 38 for enabling the seat back 20 to recline and the seat bottom 18 to slide forward in a synchronous manner as explained in more detail below. In particular, as shown in FIGS. 3 and 4, the back and bottom 18 and 20 move to their reclined position 18' and 20'.

Figure 5:
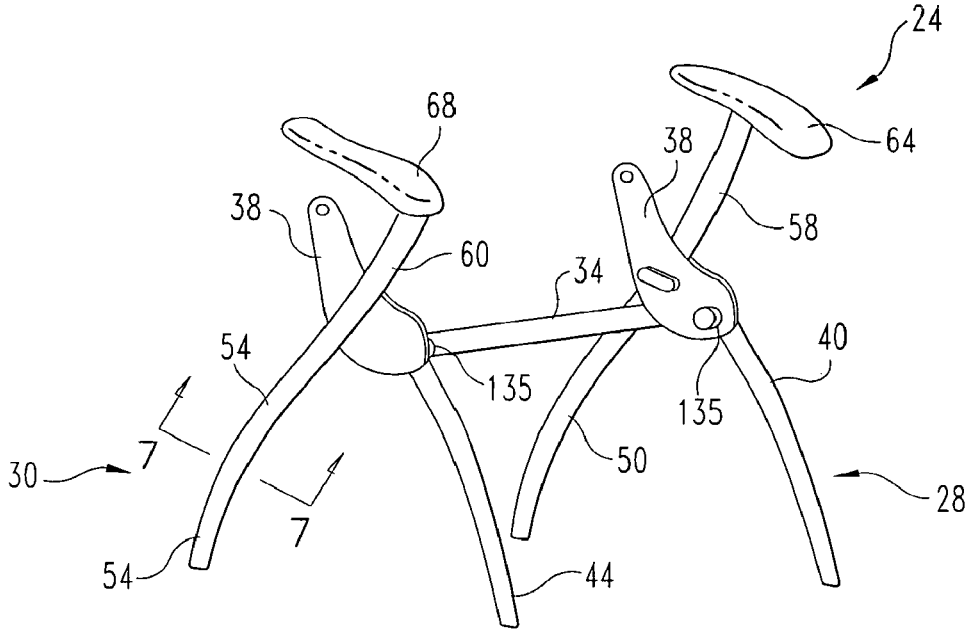
FIG. 5 is a front perspective view of a support frame of the chair of FIG. 1.
Figure 6:
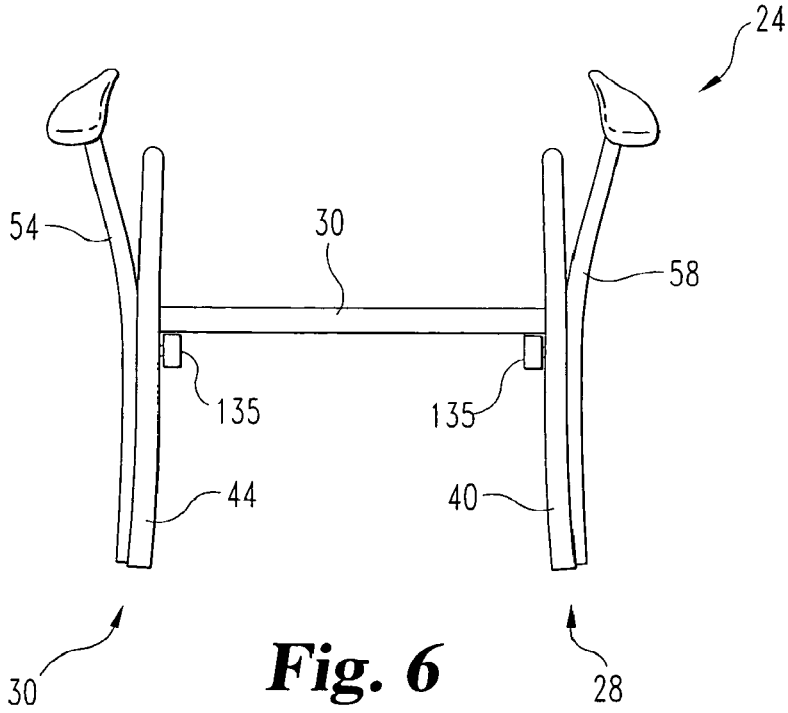
FIG. 6 is a front elevational view of a support frame of the chair of FIG. 1.

FIGS. 5 and 6 show an embodiment of the support frame 24 without the seat assembly 14. The support frame 24, which is preferably made of a metal such as steel or aluminum, has a left leg assembly 28 and a right leg assembly 30 connected by a transverse support member 34. In the embodiment of FIG. 5, each leg assembly 28, 30 includes a front leg member 40, 44, respectively, and a rear leg member 50, 54, respectively, connected in a criss-cross configuration. Lower portions of the front leg members 40, 44 and the rear leg members 50, 54 are preferably downwardly curved from the crossing point of the front leg members and the rear leg members to form an arch-like profile that provides a sturdy base for supporting and distributing the weight of a person sitting in the chair, as best seen in FIGS. 3 and 4.

Figure 7:
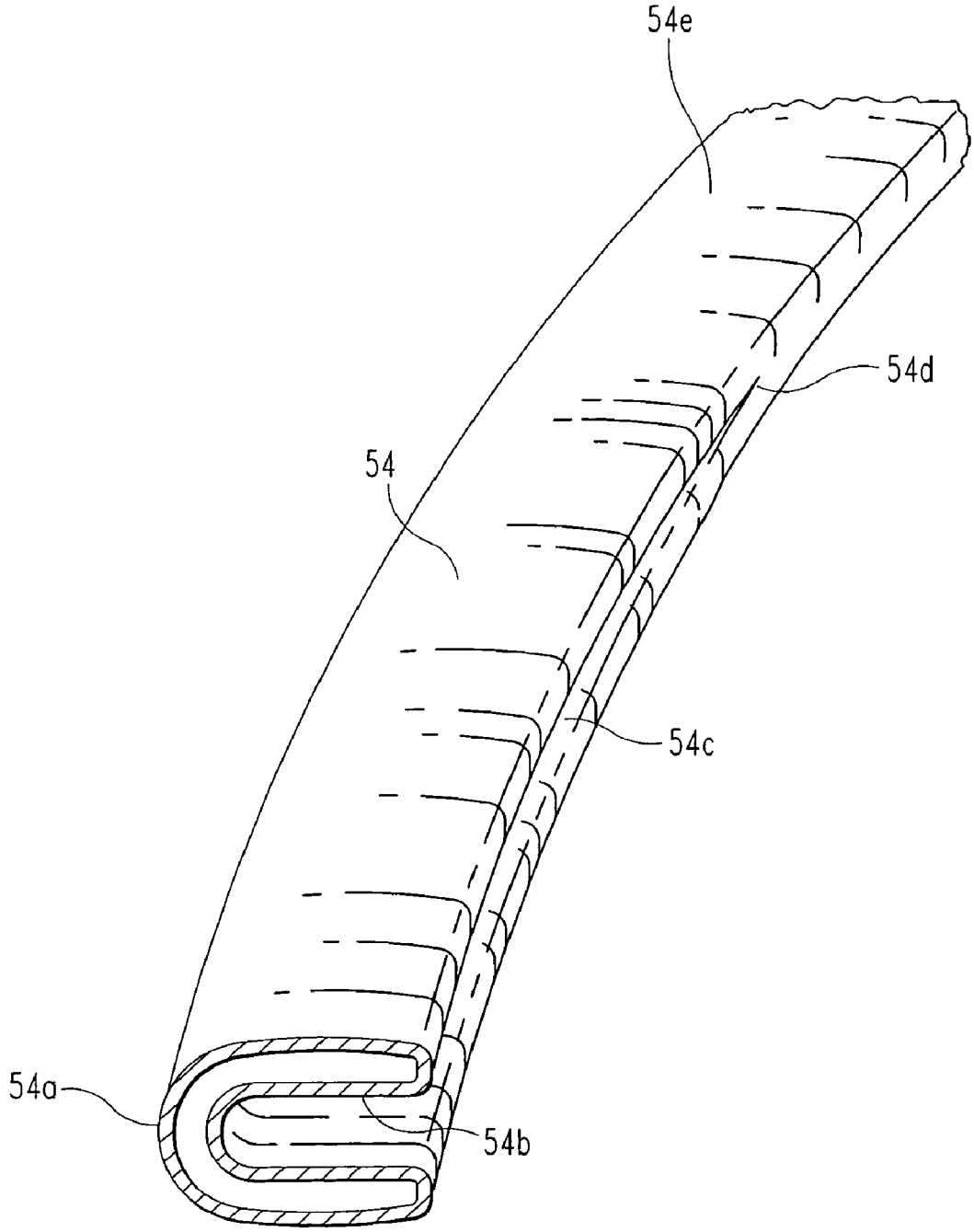
FIG. 7 is a perspective partial cross-sectional view of a portion of a leg member of the chair shown in FIG. 5, taken along line 7-7 as views in the direction of the arrows.

Preferably, the front leg members 40, 44 and the rear leg members 50, 54 are formed of a sturdy tubular metal such as aluminum or steel, for example. The tubular legs may have a wall thickness of about $1/16^{th}$ inch. In one particular embodiment, portions of the tubular front leg members and rear leg members may be constructed with a "double-d" configuration, as depicted in the cross-sectional view of FIG. 7. As can be seen, the interior portion 54*b* of the tubing of the leg member is bent towards the exterior portion 54*a* of the tubing such that the exterior portion and the interior portion exhibit a D-shaped cross-sectional profile. This construction forms a channel 54*c* that merges at location 54*d* into a purely tubular portion 54*e*, as seen in FIGS. 1 and 7. This construction provides significant bending strength to the lower portion of the leg members. In particular, this double-D construction allows the use of an elegantly contoured or curved tubular leg. This essentially creates a double walled-thickness for the leg at the most heavily loaded part of the leg. The uppermost part of the leg 54, namely the portion 54*e*, does not require the double-D construction because it is essentially above the curved, load-bearing part of the leg. A similar construction is preferably employed in the front legs 44 so that the legs include a channel 44*c* at the double-D section, a merging portion 44*d* and a purely tubular portion 44*e*. This double-D configuration for the legs significantly strengthens the legs while retaining an aesthetically appealing appearance.

Preferably, the seat back support members 38 of the leg assemblies are integral with the front leg members 40, 44 as seen in FIGS. 5 and 6. Alternatively, the front leg member may be constructed separately from the seat back support member and attached to the seat back support member using any suitable method, such as by, for example, bolting, welding, or riveting.

The rear leg members 50, 54 may include an arm portion 58, 60 in some embodiments. In these embodiments, an arm rest 64, 68 is attached at an upper end of the arm portion 58, 60 and has a free end that extends in a rearward direction from the upper end of the arm portion 58, 60 of the leg members 50, 54. Preferably, the arm rest 64, 68 is not attached to any portion of the seat assembly so it will remain stationary with respect to movement of the seat assembly as shown in FIGS. 3 and 4. This allows the seat back 20 to tilt and the seat bottom 18 to slide forward without having to move the arm rest 64, 68, thus, simplifying construction. The arm portions may be attached to the seat back support member or the front leg member or to any suitable portion of the respective support portion of the support frame. In a preferred embodiment, the rear leg members 50, 54 are positioned slightly laterally farther apart than the front leg members 40, 44 (as shown in FIG. 6) to facilitate stacking and nesting (explained in more detail below).

For certain features of the invention, the configurations of the leg members are not critical and any suitable design is contemplated. Other suitable configurations include, but are not limited to, sled, cantilever and caster-based styles (See, e.g., FIG. 23).

Figure 8:
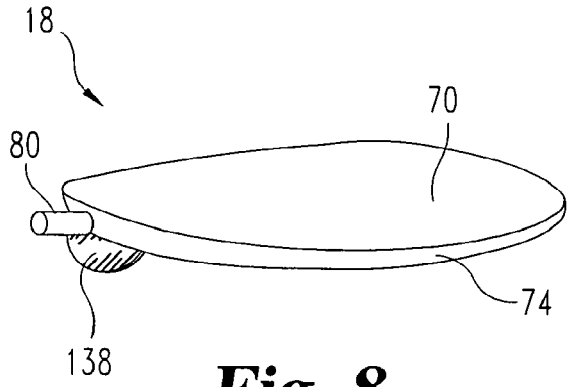
FIG. 8 is a front perspective view of a seat bottom of the chair shown in FIG. 1.
Figure 9:
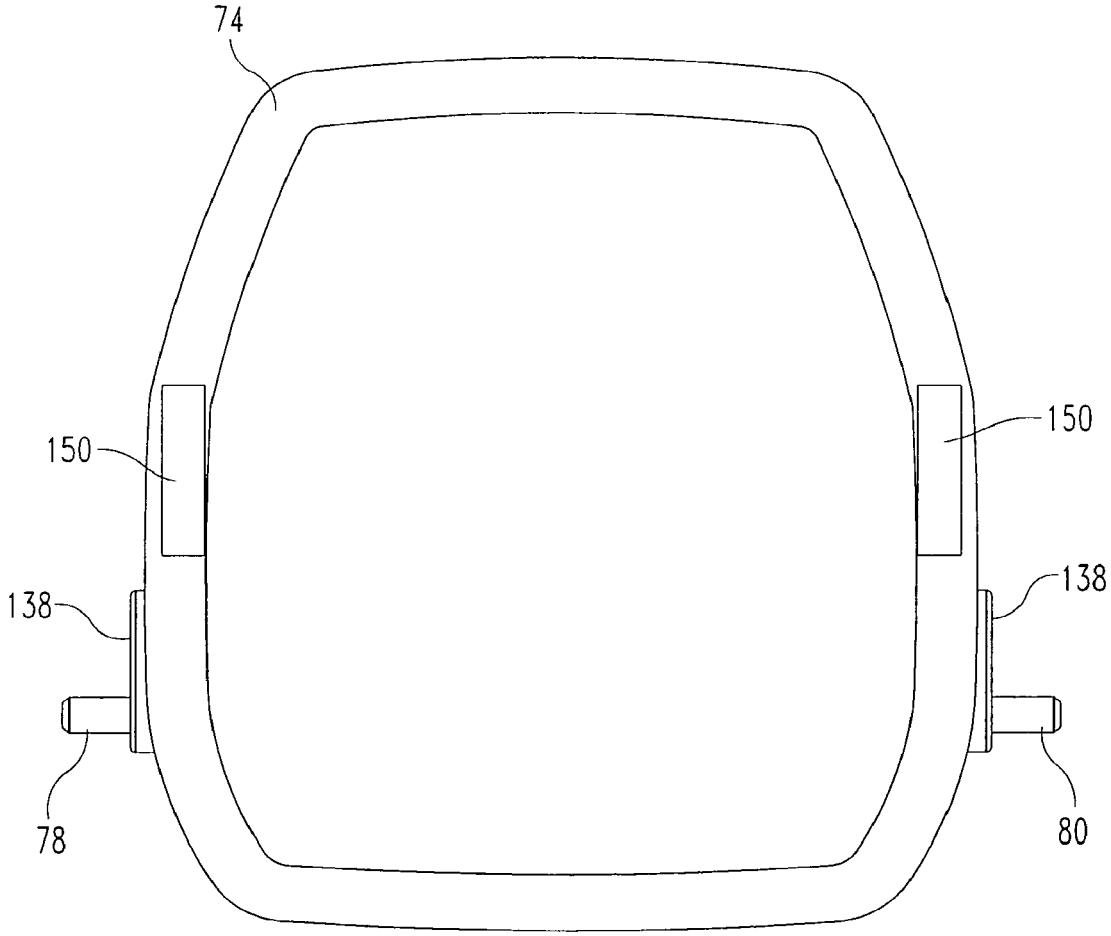
FIG. 9 is a bottom view of a seat bottom of the chair shown in FIG. 1.
Figure 12:
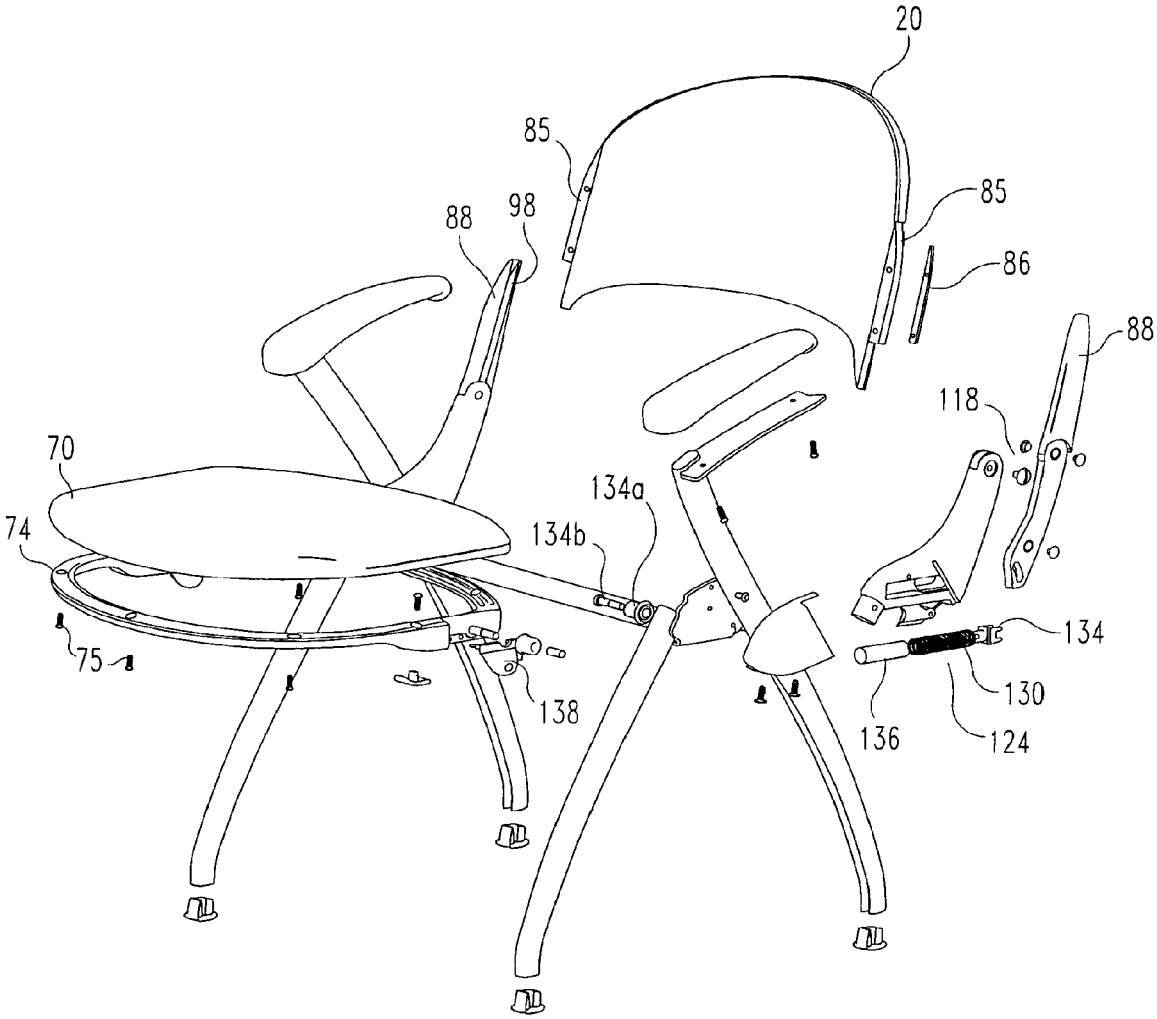
FIG. 12 is a front perspective view of the chair of FIG. 1 with the seat bottom in the upright position.

Referring now to FIGS. 8 and 9, an embodiment of the seat bottom portion 18 of the seat assembly is shown. The seat bottom portion 18 may comprise a seating surface 70 secured to a seat frame 74 in a conventional manner, such as using several screws 75 (FIG. 12). The seating surface 70 can be of many varieties, including padded or molded shell. The seat frame 74 may extend generally around the perimeter of the seating surface 70, or along the sides, front and back of the seat 70. The seating surface 70 is sized to span the distance between the left and right leg assemblies 28, 30 of the support frame 24. The seat frame includes left and right attachment members 78, 80 extending laterally from the sides of the seat bottom proximate the rear of the seat bottom for rotatable connection to seat back 20 and sliding engagement with the seat back support member 38, explained in more detail below. Preferably the frame 74 is formed of cast aluminum, or from a molded tubular plastic frame, with the attachment members 78, 80 being metal pins pressed or molded into the frame. However, other suitable frame constructions may be used.

Figure 10:
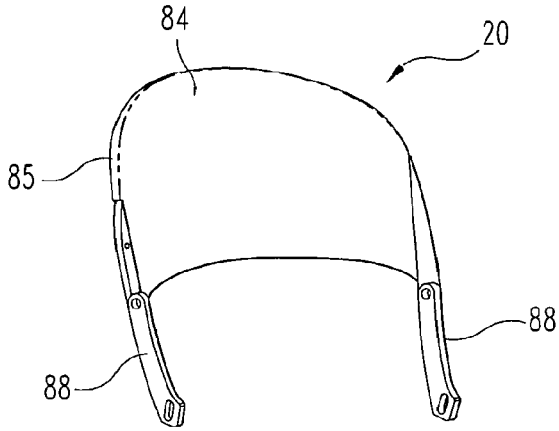
FIG. 10 is a front perspective view of a seat back of the chair shown in FIG. 1.
Figure 11:
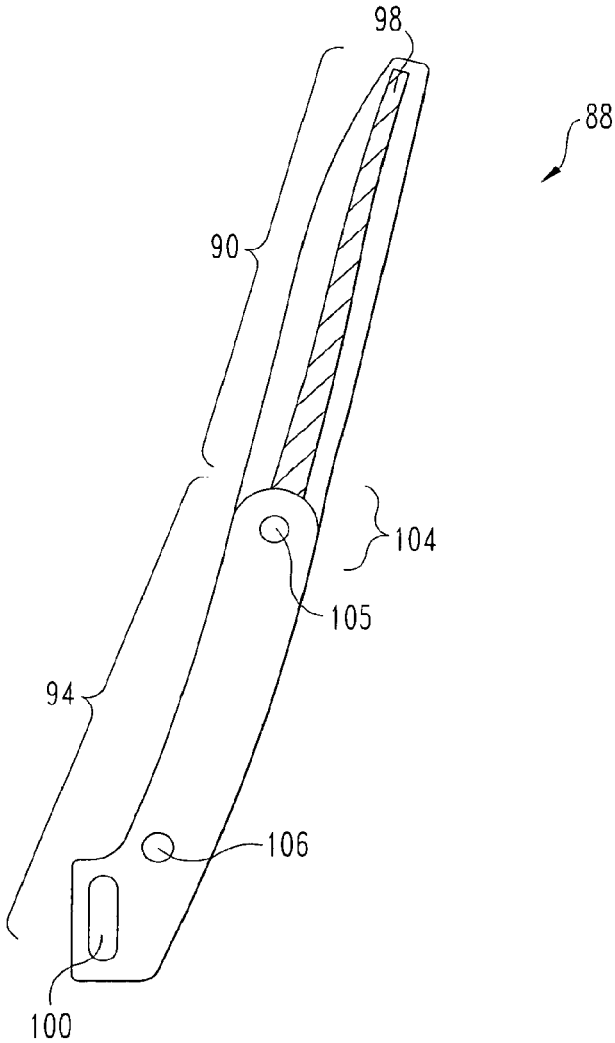
FIG. 11 is a side elevational view of an upright support member of the seat back shown in FIG. 10.

Referring now to FIGS. 10 and 11, seat back portion 20 includes a back panel 84 secured to a pair of upright support members 88. Like the seating surface 74, the back panel 84 may be of many varieties, including padded or molded shell. The upright support members 88 have an upper portion 90 for connecting to the side edges 85 (FIG. 12) of the back panel. The upright support members 88 may be attached to the back panel 84 using any suitable method. In one embodiment as shown in FIG. 11, the upright support members 88 each define a groove 98 for receiving a side edge 85 (FIG. 12) of the back panel. The side edges 85 of the back panel 84 are inserted into the groove 98 in the upright support members 88 along with a backing plate 86. The side edges 85 and backing plate 86 are attached to the upright support members 88 in any suitable manner, such as by pins pressed through aligned openings in the components. The backing plates 86 distribute the load along the side edges 85, which allows the back panel 84 to be formed of a non-metal, such as plastic or a multi-ply wood.

Figure 23:
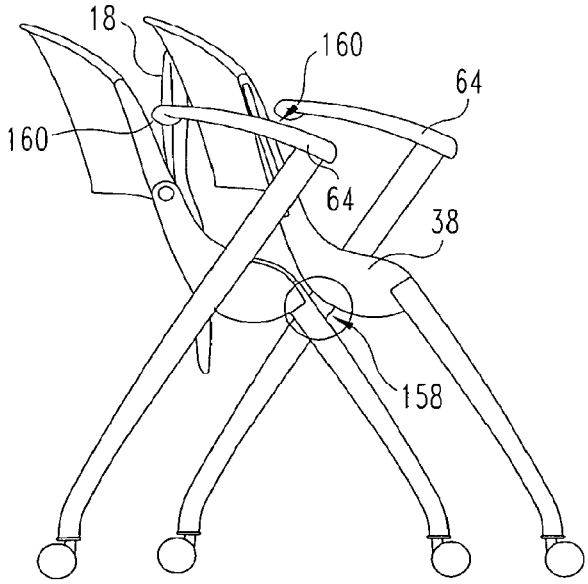
FIG. 23 is a side elevational view of two chairs nested.

A lower portion 94 of the upright support member 88 includes an opening 100 therethrough for receiving the laterally extending members 78, 80 of the seat bottom 18. The laterally extending members 78, 80 may translate and rotate within the opening 100 so that the seat bottom 18 may be rotated into an upright position (as shown in FIG. 23). A central portion 104 of the upright support member 88 defines a pivot axis 105 or fulcrum about which the seat back portion 20 can pivot or rotate relative to the support frame 24 to and from a reclined seating position. The upright support members 88 may be formed of any material sturdy enough to support the back panel against the weight of a person sitting in the chair. Preferably, the upright support members are formed of a metal, such as cast aluminum or steel. The lower portion 94 may further define an opening 106 to receive a bearing pin (not shown) that bears against support member 38 to facilitate movement of the portion 94 within that member.

The back panel 84 and seating surface 70 may be curved to adapt to a user's body for comfort. The back panel and seating surface may be formed of any suitable material and may be cushioned or padded for additional comfort. The comfort and durability of the chair may be further enhanced by providing a back panel and seating surface that are formed of a relatively flexible material that flexes, bends, or deflects slightly in response to, and proportional to, a user's weight such as, for example, molded plastic or a multiple ply wood. The walls of the back panel and seating surface may be of generally uniform thickness, but may have increased thickness where required for strength. Stiffening ribs or flanges may also be added as required.

Figure 14:
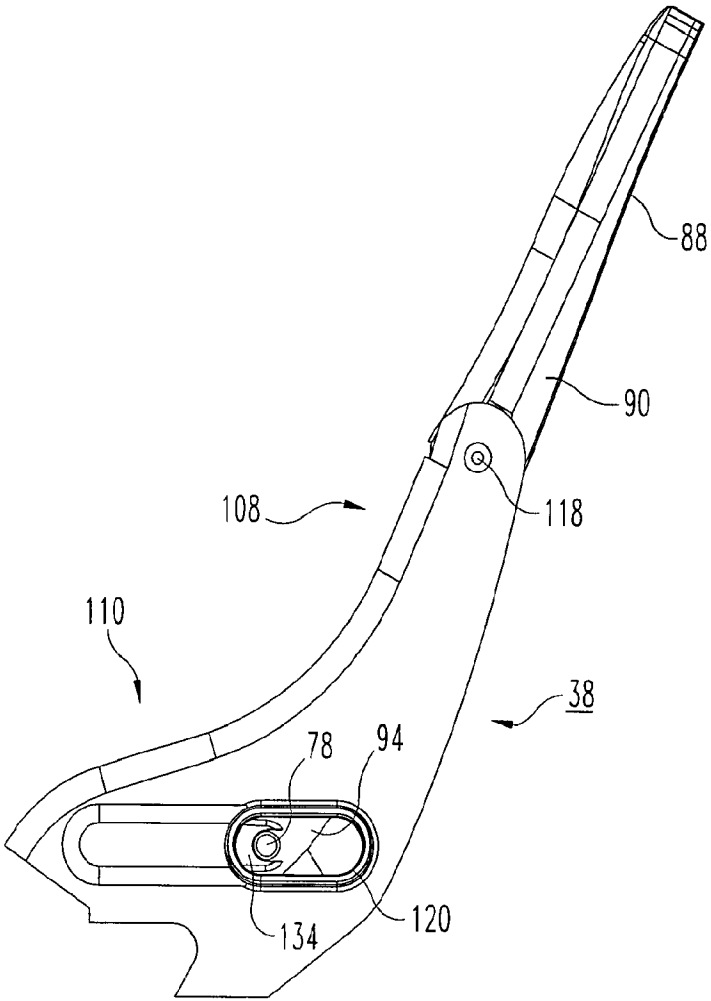
FIG. 14 is a side elevational view of a seat back support member of the chair in FIG. 1 in the reclined position.
Figure 16:
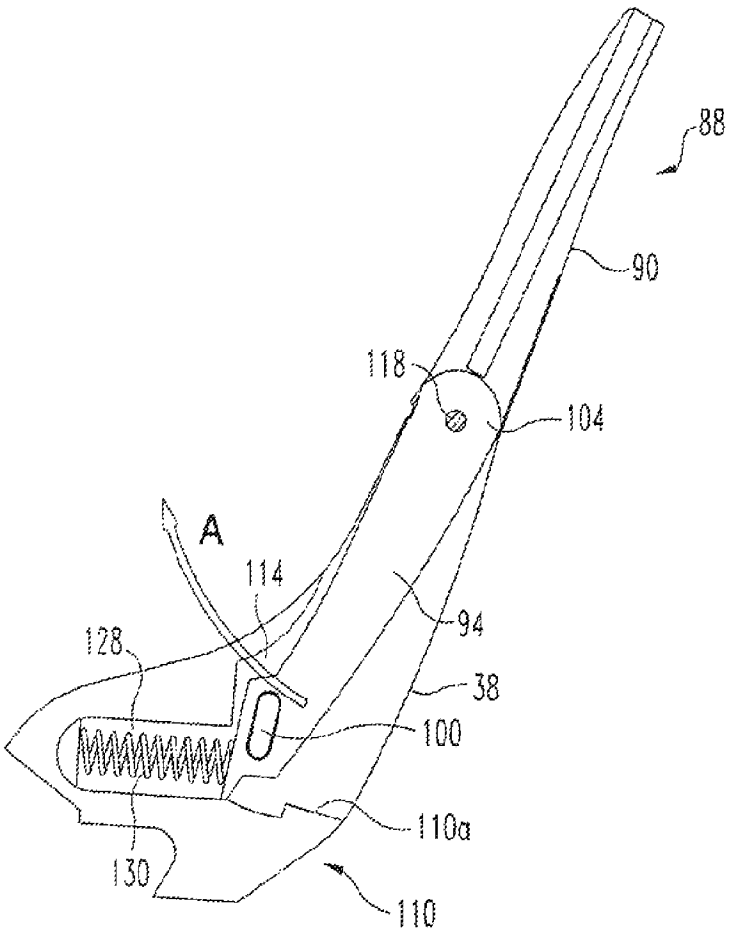
FIG. 16 is a side cross-sectional elevational view of a seat back support member of the chair in FIG. 1 in the reclined position.
Figure 15:
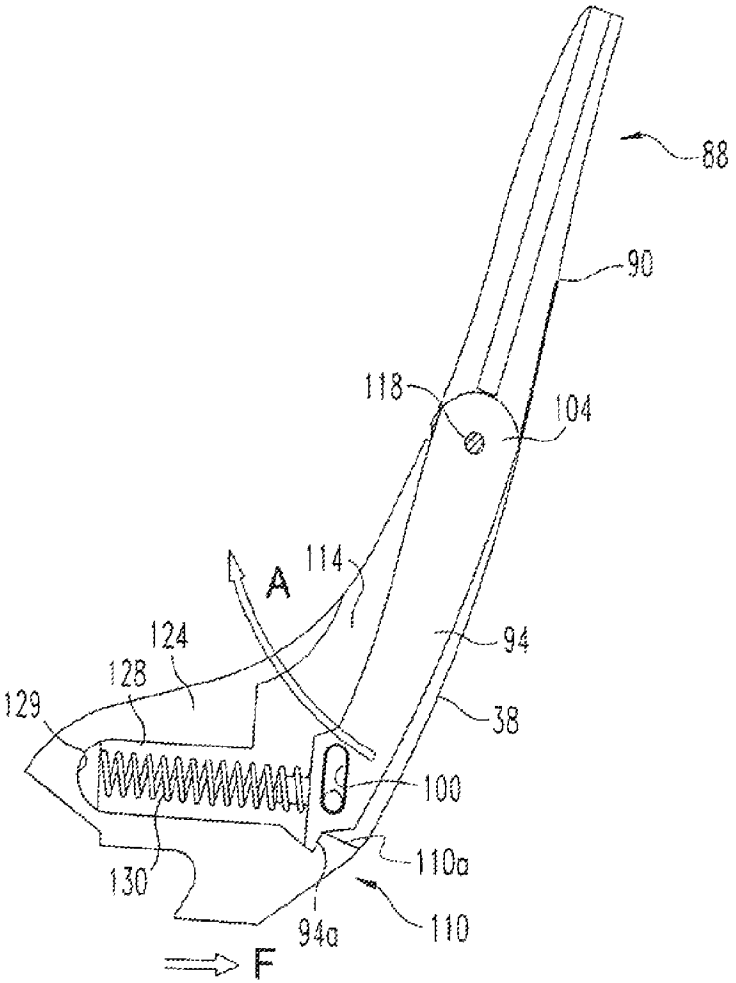
FIG. 15 is a side cross-sectional elevational view of a seat back support member of the chair in FIG. 1.

The seat back support member 38 is operable to allow the seat back portion of the chair 10 to pivot, or tilt, rearwardly while the seat bottom slides forward. Details of the member 38 are best understood with reference to FIGS. 13-16. The seat back support member 38 includes a generally upright upper portion 108 and a generally forward extending lower portion 110. In one embodiment, the upright portion 108 includes a pivot guide channel 114 (FIG. 15) sized to receive the lower portion 94 of the upright support members 88. The central portion 104, or pivot point 105 (FIG. 11), of the upright support members 88 of the seat back is pivotably attached at the upper end of the pivot guide channel 114 so that the upper portion 90 of the upright support member 88 extends generally upward from the seat back support member 38 and is pivotable from an upright position (FIGS. 13 and 15) to a reclined position (FIGS. 14 and 16). The pivot pin 118 may be fixed to the pivot guide channel 114 in any suitable method. In one specific embodiment, the pin includes a keyed cap screw and bushing assembly depicted in FIG. 12. As can be seen in FIGS. 15 and 16, the pivot guide channel 114 defines a space in which the lower portion 94 of the upright support members may move in response to the pivoting of the upper portion 90 of the upright support members.

Once inserted into the pivot guide channel 114, the lower portion 94 of the upright support member extends into the lower portion 110 of the seat back support member 38. The seat back support member 38 further includes a slide guide opening 120 (FIG. 13) on an inboard side of each of the respective seat back support members 38. The lower portions 94 of the upright support members and the attachment members 78, 80 of the seat bottom are rotatably connected within the pivot guide channel 114 through the respective slide guide openings 120. Specifically, the attachment members 78, 80 fit through a respective slotted opening.

As the lower portion 94 of the upright support member is pivoted into the reclined position, the slotted opening 100 of the lower portion 94 of each upright support member is moved in a forward arc A within the pivot guide channel 114. Thus, the slotted opening 100 is displaced vertically and horizontally while moving from the upright position (FIG.

15) to the reclined position (FIG. 16). In order to ensure that the seat bottom 18, or the rear portion of the seat bottom, is not vertically displaced as the seat bottom slides forward, the slot 100 in the lower portion 94 of the upright support member is preferably elongated in the vertical direction as shown in FIG. 11 so that the lower portion never exerts an upward force on the attachment members 78, 80.

Figure 22:
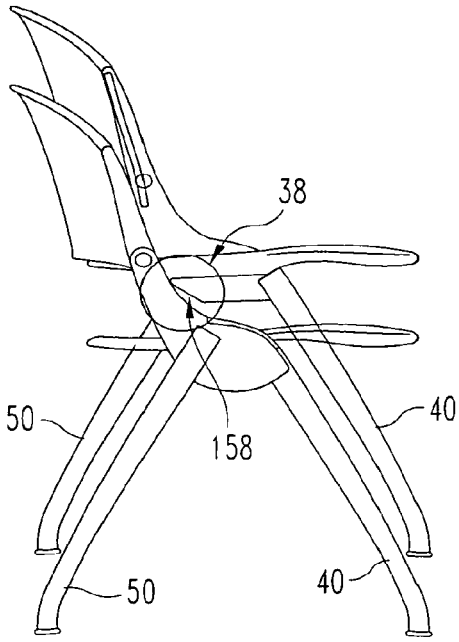
FIG. 22 is a side elevational view of two chairs stacked.

It can be appreciated that the interface between the attachment members 78, 80 and the slotted openings 100 couple the seat bottom 18 and seat back 20 to move in synchronization. Backward tilting of the seat back causes forward movement of the seat bottom. Backward movement of the seat bottom causes forward tilting of the seat back. In one feature of the invention, this coupling of seat bottom and seat back movement does not compromise the ability to rotate the seat bottom to its nesting position, as illustrated in FIG. 22. In other words, the attachment members 78, 80 act as a pivot axis for the seat bottom. The slotted openings 100 do not restrict that relative rotation. Thus, the present invention provides a nestable chair that permits synchronous movement between seat bottom and seat back.

Figure 13:
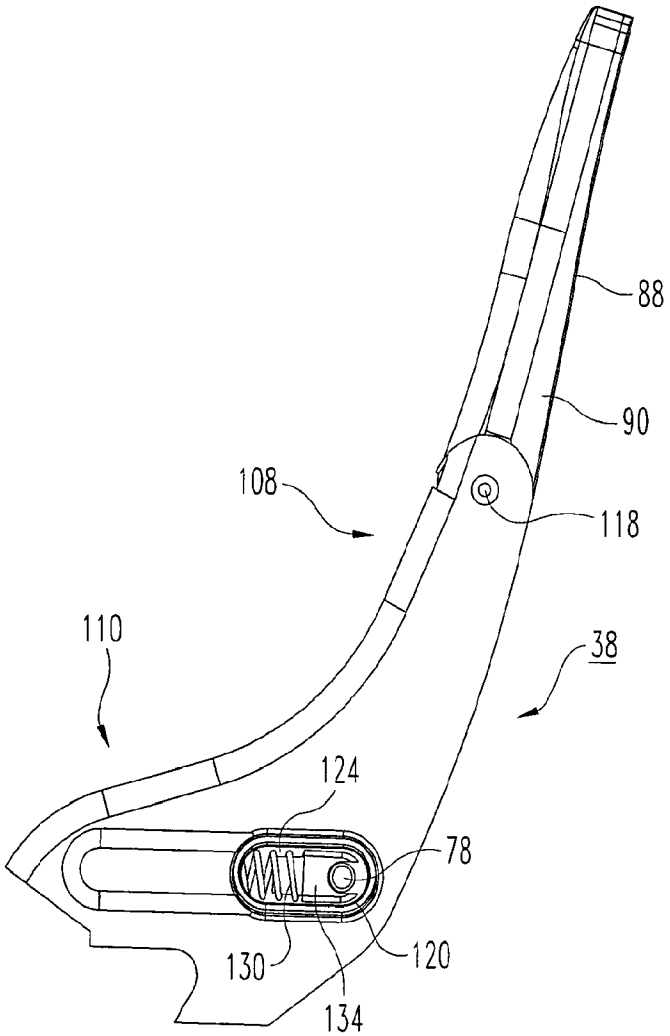
FIG. 13 is a side elevational view of a seat back support member of the chair in FIG. 1.

The seat back support member 38 preferably further includes a biasing element 124 for biasing the seat back portion into the upright position (FIG. 3). Referring to FIGS. 12-16, in one embodiment, seat back support member 38 may include a guide chamber 128 in the lower portion 110 of the seat back support member. The guide chamber 128 is open at one end to the pivot guide channel 114. A biasing spring 130 is positioned within the guide channel 114 to bear against the base of the chamber and against the lower portion 94 of the upright support member 88 adjacent the slotted opening 100. The biasing spring 130 applies a rearward biasing force in direction F on the lower portion 94 of the upright support member thereby biasing the lower portion 94 rearward and pivoting the upper portion 90 into the upright position (FIGS. 3, 13 and 15).

Figure 17:
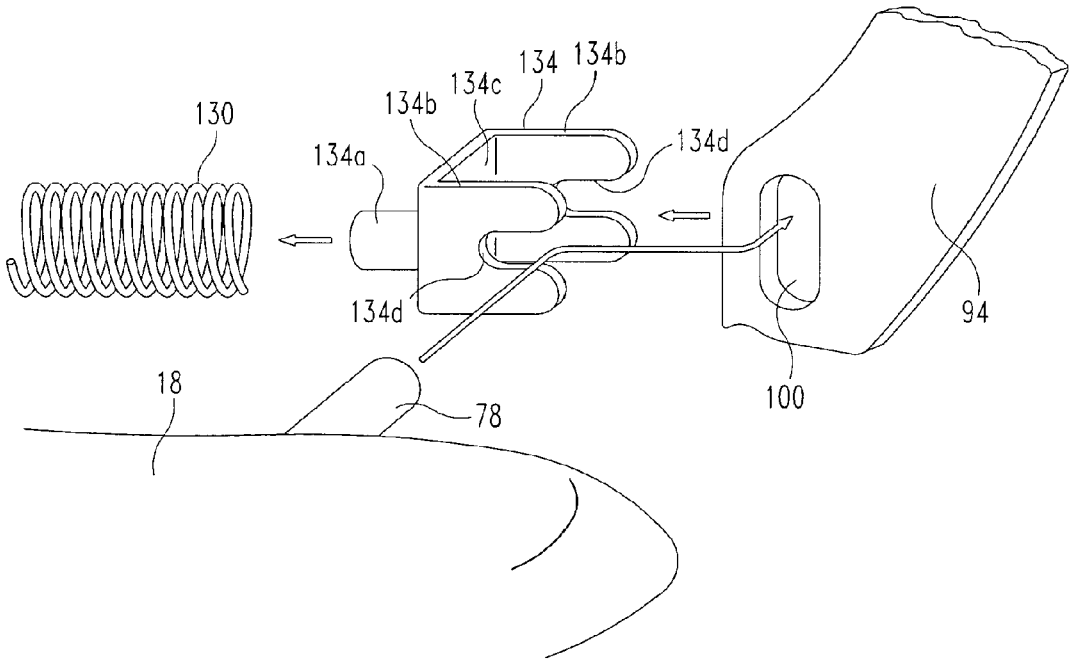
FIG. 17 is an enlarged perspective view of a biasing mechanism within the seat back support member depicted in FIGS. 13-16.

In the preferred embodiment, the interface between the spring 130 and the lower portion 94 is facilitated by a yoke element 134, as illustrated in FIG. 17. The yoke element includes a post 134*a* that extends into the spring 130. The body of the element further includes arms 134*b* that are separated to form a channel 134*c* to receive the end of the lower portion 94 with the slotted opening 100 within the channel. The arms define slots 134*d* that align with the opening 100 and receive the attachment member 78 therethrough. Thus, the attachment member 78, lower portion 94 and yoke element 134 all move together as the seat back is tilted.

When a person sitting in the chair leans back with sufficient force to overcome the biasing force in the springs 130, the springs 130 compress and allow the lower portion 94 of the upright support member to pivot forward and the upper portion 90 to pivot backward into the reclined position (FIGS. 4, 14 and 16). The forward and rearward limits are established by engagement between the laterally extending members 78, 80 of the seat bottom and the slide guide opening 120 of the seat back support member 38. When the backward force on the seat back 20 is removed, the springs 130 restore the seat back 20 to the upright position (FIGS. 3, 13 and 15). In the illustrated embodiment, a sheath 136 is provided that fits over the spring 130. The sheath provides an interface between the spring and the guide chamber 128 to decrease noise as the spring compresses. Preferably the sheath 136 is a plastic or nylon mesh. A further backward limit may be established by a tang 94*a* (FIGS. 15 and 17) projecting from the lower portion 94 to contact rib 110*a* of the seat back support member 110.

Referring back to FIGS. 1 and 5, the chair preferably includes seat stop 135 mounted to each front leg member 44 forward of the transverse support member 34. The seat stops 135 prevent the seat bottom 18 from rotating downward past the horizontal position. In a preferred embodiment, seat stops 135 are positioned to engage the bottom portion of the lateral sides of the seat bottom support frame 74 at least midway along the sides of the seat bottom from the back of the seat bottom. This positioning places the force of a sitting person substantially onto the stops 135 and not onto the forward unsupported portion of the seat bottom.

The seat stops 135 may be any suitable member or device that is capable of supporting the seat bottom 18 when a person is seated on the chair. In a specific embodiment, the seat stop 135 includes a busing 135*a* that projects inwardly from each of the left and right support portions 44 of the support frame. The bushings 135*a* may be formed of any hard, durable material, such as, for example, a hard plastic. The bushings 135*a* are preferably attached to the inboard side of the respective support portion of the support frame in a way that allows the bushings to pivot to act as a roller as the seat bottom 18 moves back and forth. One suitable attachment is by a carriage bolt 135*b* passing through the bushing and threaded into the frame.

Figure 18:
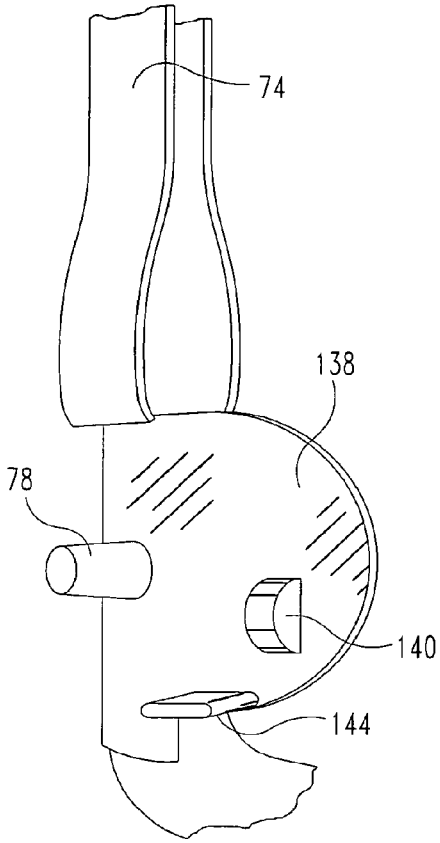
FIG. 18 is a perspective view of a cover fin.
Figure 19:
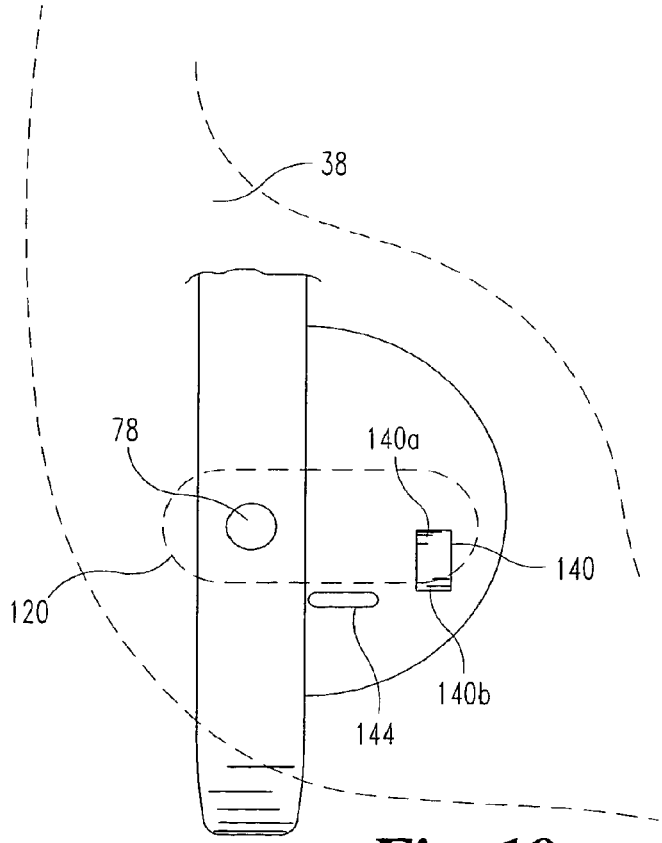
FIG. 19 is another view of the cover fin of FIG. 18.

When the seat bottom is in the upright position (FIG. 12), a portion of the slide guide opening 120 may be exposed. Thus, the chair preferably includes a cover fin 138 for covering the open portion of the slide guide opening 120 when the seat bottom 18 is in the upright position (FIG. 23). One embodiment of a cover fin 138 for covering the slide guide opening 120 is shown in FIG. 18. The cover fin 138 comprises a flexible plate member attached to the seat bottom support frame 74 below the laterally extending attachment members 78. When the seat bottom 18 is in the upright position, the cover fin 138 extends forward from the seat bottom 18 to cover the forward portion of the slide guide opening, as shown in FIG. 19.

In accordance with a further feature of certain embodiments, the cover fin 138 includes a first detent 140 configured to prevent the seat bottom 18 from freely falling from the upright position to the horizontal position. The first detent 140 may comprise a protrusion on the outboard side of the cover fin 138. When the seat bottom 18 is rotated to the upright position, the cover fin 138 slides along the edge of the slide guide opening 120. Once the seat bottom has reached the upright position, the first detent slides into a position just inside the rim of the slide guide opening 120 as shown in FIG. 19. In one embodiment, a leading portion 140*a* of the first detent 140 is ramped so that the first detent may easily slide past the rim of the slide guide opening 120 when the seat bottom is rotated upward. Once the first detent 140 is within the slide guide opening 120, the trailing portion 140*b* of the first detent is configured to abut against the rim of the opening to prevent the seat bottom from coming down. The trailing portion 140*b* is preferably generally blunt. It is contemplated that the fin 138 is formed of a slightly bendable material so that the fin flexes as the detent 140 passes across the rim of the guide opening 120. This flex or resilience also holds the detent within the opening until the seat bottom is tilted down.

The cover fin 138 may further include a second detent 144 configured to prevent rotation of the seat bottom 18 upward past the upright position. The detent 144 projects laterally outward from the cover fin. When the seat bottom 18 is rotated upward and the first detent 140 has passed into the slide guide opening, the second detent 144 is positioned to catch on the outside rim of the slide guide opening 120 to prevent further rotation of the seat bottom.

Figure 20:
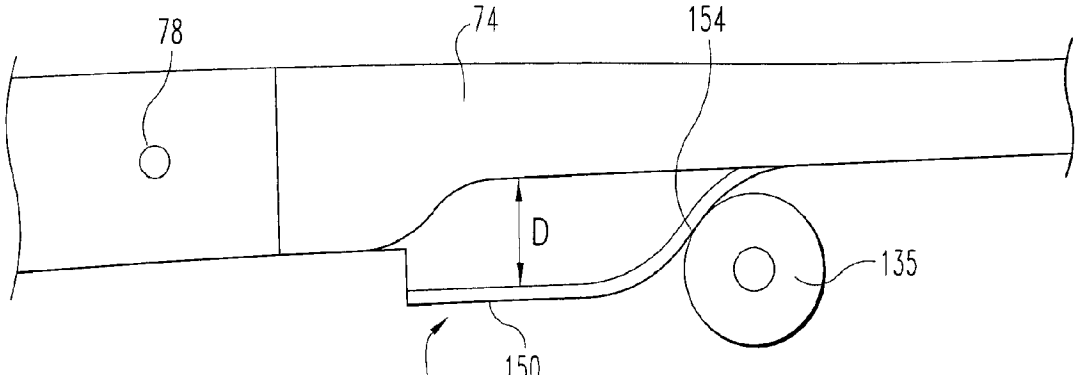
FIG. 20 is a side elevational view of a seat stop and ramp for a seat bottom.
Figure 21:
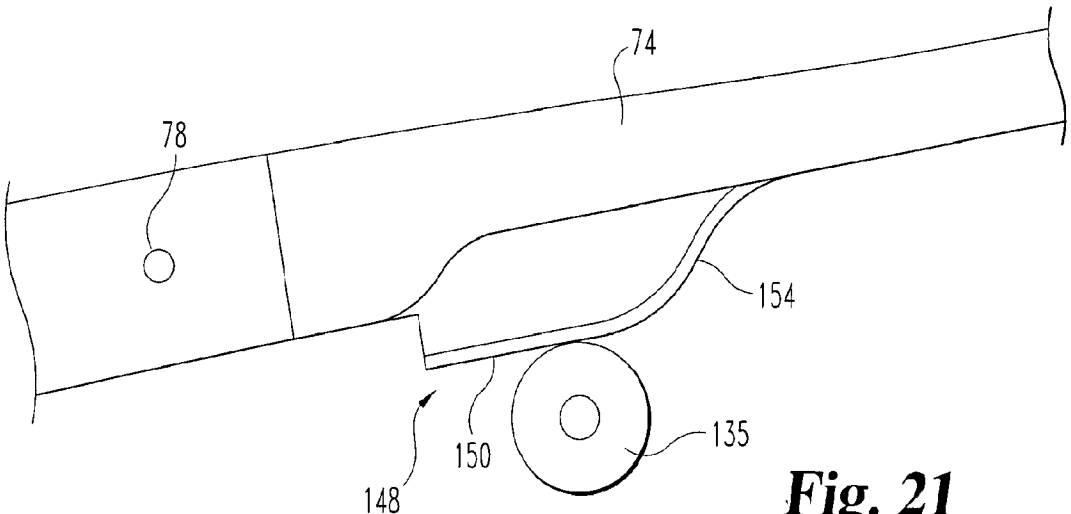
FIG. 21 is another side elevational view of a seat stop and ramp for a seat bottom.

Referring now to FIGS. 20 and 21, there is shown an additional comfort enhancing feature of the chair 10 of the present invention. This feature comprises a ramp 148 affixed to the bottom portion of the support frames 74 where the seat bottom support frames contact a corresponding seat stop 135. The ramp 148 has a generally flat rear portion 150 that is spaced a distance D from the bottom portion of the seat frame 74. The front portion 154 of the ramp is rounded or curved. As the seat back 20 is tilted back into the reclined position, the seat bottom 18 slides forward causing the ramp 148 to slide atop the seat stop 135. As shown in FIG. 20, when the seat back is in the upright position, the seat stop 135 is positioned at or near the front curved portion 154 of the ramp 148. As the seat bottom slides forward, the seat stop 135 bears against the curved portion 154 of the ramp causing the front of the seat bottom to be raised slightly relative to the rear portion of the seat bottom. When the seat back reaches the reclined position, the seat stop 135 is engaging the flat rear portion 150 of the ramp thus keeping the front portion of the seat bottom 18 angled slightly upward. Angling the front portion of the seat bottom upward when in the reclined position prevents a person from slipping forward in the seat as they are reclining and more closely follows a comfortable body position for the person.

As discussed above, the positioning of the leg members and the rotatability of the seat bottom allows the chair 10 to be stacked and nested with other similar chairs to facilitate storage. This capability is shown in FIGS. 22 and 23. To facilitate the stacking and nesting of the chairs, the front leg members are positioned closer together than the rear leg members as shown in FIGS. 1, 2, 5 and 6. Thus, when stacking vertically, as shown in FIG. 22, the front leg members 40 of a stacked chair rest above the front leg members of the chair below it and rear leg members 50 are above the rear leg members of the chair below it in a "leg-on-leg" configuration. Additionally, the arm portion of the rear leg members may be flared outward so that the arm portion does not block, or otherwise interfere, with the stacking of the chairs.

When nesting the chairs horizontally, as shown in FIG. 23, the seat bottoms 18 of the chairs to be nested are rotated into an upright position. This allows a first chair to be pressed horizontally against a second chair without interference or blocking caused by the seat bottom 20. Again, because of the front leg members of the chairs are positioned closer together than the rear leg members, the seat back portion of the seat assembly of a nested chair fits between the arm portion of the chair behind it while the rear leg members of the chair to be nested fits outside the front leg members of the chair behind it.

Referring again to FIGS. 21, 22 and 23, the chair preferably includes stack/nest bumpers 158 positioned on the chair to minimize contact between stacked or nested chairs. The stack/nest bumpers 158 may be formed of a hard, durable material such as a hard plastic. The stack/nest bumpers 158 minimize contact and rubbing of chair parts thereby improving the durability and extending the life of the chair. A bumper 158 may be placed in any position where contact between stacked or nested chairs is likely. For example, in the embodiments shown in FIGS. 21, 22 and 23, a bumper 158 is placed on a bottom inboard portion of each seat back support member 38 where there is contact between the leg members and seat back support members of stacked or nested chairs. Additionally, a bumper guard 160 may be positioned on the rear bottom portion of the arm rests 64 as shown in FIG. 23 to minimize contact between the nested arm rests of the chairs. Moreover, the guard 160 can be sized to prevent a user's sleeve from sliding over the cantilevered arm 64.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A chair comprising:

a support frame having ground engaging legs;

a seat back including a back panel connected to a left and a right upright support member, said upright support members being connected to said support frame by a pivotal connection positioned within channels formed in said support frame; and a seat assembly including a seat bottom connected to a left and a right laterally extending attachment member, said left laterally extending attachment member being configured to extend through a slot in said left upright support member and a left opening in one of said channels, said right laterally extending attachment member being configured to extend through a slot in said right upright support member and a right opening in another of said channels, such that said seat assembly is configured to pivot about a pivot axis formed by said attachment members between a generally horizontal and a generally vertical position.

2. The chair of claim 1 wherein said support frame is configured to enable said chair to be stacked with other chairs having a similar support frame configuration when said seat bottom is in said generally horizontal position.

3. The chair of claim 2 wherein said support frame is further configured to allow said chair to be nested with other chairs having a similar support frame configuration when said seat bottom is in said generally vertical position.

4. The chair of claim 1 further comprising:

a left armrest connected to an upper end of a left rear leg member of said ground engaging legs;

a right armrest connected to an upper end of a right rear leg member of said ground engaging legs;

a left bumper connected to a rear portion of said left armrest; and a right bumper connected to a rear portion of said right armrest.

5. The chair of claim 4 wherein said bumpers are configured to prevent a user wearing a shirt from extending said rear portion of said left armrest through a sleeve of said shirt and from extending said rear portion of said right armrest through said sleeve of said shirt.

6. The chair of claim 1 wherein said seat assembly is further configured to slide forward relative to said support frame in response to said upright support members being pivoted in a first direction.

7. The chair of claim 6 further comprising:

a ramp member connected to said seat bottom, said ramp member being configured to tilt a front portion of said seat bottom upward in response to said seat assembly sliding forward.

8. The chair of claim 6 further comprising:

a left biasing member positioned within a left guide chamber of said support frame; and a right biasing member positioned within a right guide chamber of said support frame, wherein said biasing members are configured to bias said seat assembly backward relative to said support frame.

9. The chair of claim 8 further comprising:

a left noise suppressing member associated with said left biasing member; and a right noise suppressing member associated with said right biasing member.

10. The chair of claim 6 wherein said upright support members exert an approximately horizontal force on said attachment members.

11. A chair comprising:

a support frame having ground engaging legs;

a seat back including a back panel connected to a left and a right upright support member, each of said upright support members being pivotally connected to said support frame, a lower portion of said left upright support member being positioned completely within a left pivot channel formed in said support frame, and a lower portion of said right upright support member being positioned completely within a right pivot channel formed in said support frame; and a seat bottom connected to a left and a right attachment member, said left attachment member being pivotally connected to said left upright support member by passing through a left opening in said left pivot channel of said support frame and said right attachment member being pivotally connected to said right upright support member by passing through a right opening in said right pivot channel of said support frame, wherein said seat bottom slides forward relative to said support frame in response to said upright support members being pivoted in a rearward direction.

12. The chair of claim 11, wherein said lower portion of said left upright support member extends downward from said pivotal connection to said support frame to said pivotal connection to said left attachment member and said lower portion of said right upright support member extends downward from said pivotal connection to said support frame to said pivotal connection to said right attachment member.

13. The chair of claim 12, wherein said upper portion of said left upright support member extends upward from said pivotal connection to said support frame to said connection to said back panel and said upper portion of said right upright support member extends upward from said pivotal connection to said support frame to said connection to said back panel.

14. The chair of claim 11 wherein said support frame is configured to enable said chair to be stacked with other chairs having a similar support frame configuration when said seat bottom is in said generally horizontal position.

15. The chair of claim 11 wherein said support frame is further configured to allow said chair to be nested with other chairs having a similar support frame configuration when said seat bottom is in said generally vertical position.

16. A chair, comprising:

a seat back including a left and a right upright support member;

a seat bottom;

a left seat back support member including a left pivot guide channel and a left slide opening formed on an inboard side of said left seat back support member to provide access to said left pivot guide channel, a lower portion of said left upright support member is positioned within said left pivot guide channel and said seat bottom is connected to said left upright support member by a rotatable connection through said left slide opening; and a right seat back support member including a right pivot guide channel and a right slide opening formed on an inboard side of said right seat back support member to provide access to said right pivot guide channel, a lower portion of said right upright support member is positioned within said right pivot guide channel and said seat bottom is connected to said right upright support member by a rotatable connection through said right slide opening, wherein said seat bottom is configured to slide to a first seat bottom position in response to said upright support members pivoting to a first seat back position and to slide to a second seat bottom position in response to said upright support members pivoting to a second seat back position.

17. The chair of claim 16, further comprising:

a first and a second cover fin connected to said seat bottom, wherein said seat bottom is rotatable between a generally horizontal position and a generally vertical position, and said cover fins are configured to cover at least a portion of said slide openings when said seat bottom is rotated to said generally vertical position.

18. The chair of claim 16, the seat bottom further comprising:

a left laterally extending attachment member extending through said left slide opening and said lower portion of said left upright support member; and a right laterally extending attachment member extending through said right slide opening and said lower portion of said left upright support member, wherein said left laterally extending attachment member slides within said left slide opening when said seat bottom slides to said first seat bottom position and said right laterally extending attachment member slides within said right slide opening when said seat bottom slides to said first seat bottom position.

19. The chair of claim 16, further comprising:

a left biasing member positioned in said left pivot guide channel;

a right biasing member positioned in said right pivot guide channel;

a left sheath associated with said left biasing member; and a right sheath associated with said right biasing member, wherein said biasing members are configured to bias said upright support members in said second seat back position, and said sheaths are configured to decrease noise as said biasing members bias said upright support members.

20. The chair of claim 16, wherein said seat bottom is rotatable between a generally horizontal position and a generally vertical position, said chair is configured to be stacked with a similar chair when said seat bottom is in said generally horizontal position, and chair is further configured to be nested with a similar chair when said seat bottom is in said generally vertical position.

* * * * *